US006746285B2

(12) United States Patent
Delcourt et al.

(10) Patent No.: US 6,746,285 B2
(45) Date of Patent: Jun. 8, 2004

(54) GROUNDING STUD

(75) Inventors: Mark H. Delcourt, Emmett, MI (US); Thomas Gouin, Grosse Pointe Woods, MI (US)

(73) Assignee: Newfrey LLC, Newark, DE (US)

( * ) Notice: Subject to any disclaimer, the term of this patent is extended or adjusted under 35 U.S.C. 154(b) by 94 days.

(21) Appl. No.: 10/075,090

(22) Filed: Feb. 12, 2002

(65) Prior Publication Data

US 2002/0115317 A1 Aug. 22, 2002

Related U.S. Application Data

(60) Provisional application No. 60/270,084, filed on Feb. 20, 2001.

(51) Int. Cl.[7] ..... H01R 4/38
(52) U.S. Cl. ..... 439/766
(58) Field of Search ..... 439/80, 92, 766, 439/883; 174/51; 411/107, 181

(56) References Cited

U.S. PATENT DOCUMENTS 4,192,215 A * 3/1980 Hymans ..... 411/548
5,207,588 A 5/1993 Ladouceur et al.
5,292,264 A 3/1994 Blank
5,413,500 A * 5/1995 Tanaka ..... 439/521
5,442,133 A * 8/1995 Arnold et al. ..... 174/51
5,655,936 A * 8/1997 Meredith ..... 439/801
6,077,096 A * 6/2000 Moring et al. ..... 439/92
6,244,517 B1 * 6/2001 Courtois et al. ..... 238/14.05
6,357,110 B1 3/2002 Shipp et al.
6,491,487 B1 * 12/2002 Wojciechowski ..... 411/181
6,607,339 B1 * 8/2003 Mangapora ..... 411/107

FOREIGN PATENT DOCUMENTS

EP 0 487 365 B1 5/1992

OTHER PUBLICATIONS

Internet Publication of Emhart Fastening Teknologies—NPR Studs, 2 pages (published Jul. 1, 1999).
Internet Publication of Parker—Kalon Projection Weld Screws, 4 pages (published Jul. 1, 1999).

* cited by examiner

*Primary Examiner*—Lynn Feild
*Assistant Examiner*—Thanh-Tam Le
(74) *Attorney, Agent, or Firm*—Harness, Dickey & Pierce, P.L.C.

(57) ABSTRACT

A preferred embodiment of an electrical connection employs a stud having a patterned segment, a shoulder and a flange. In another aspect of the present invention, the shoulder has seven or more predominantly flat faces. In a further aspect of the present invention, the shoulder has an octagonal cross sectional shape.

15 Claims, 3 Drawing Sheets

GROUNDING STUD

BACKGROUND OF THE INVENTION

This invention relates generally to an electrical connection and more specifically to an electrical connection for an automotive vehicle employing a grounding stud.

It is common to arc weld an elongated circular end of a threaded metal stud onto a sheet metal body panel of an automotive vehicle. Various parts are then inserted upon the single threaded stud and an internally threaded nut is rotationally inserted onto the stud. Conventional threaded weld studs have also been employed as electrical grounding points for a vehicle wire harness to an engine compartment frame or body panel. It is also known to employ a grounding weld stud that has a threaded portion, a circular flanged portion and a hexagonal shoulder portion for receiving an eyelet. This hexagonal shoulder configuration, however, provides undesirably large corner-to-corner and flat-to-flat dimensions across the shoulder in order to fit within standard stud welding machinery which can only handle a certain maximum outside diameter of stud; thus, the hexagonal shoulder leads to insufficient cross sectional area for electrical conductivity.

Screws have also been used to retain an electrical eyelet to a grounding panel. Conventional eyelets, having a circular inside aperture, often require upturned tabs to prevent rotation of the eyelets during installation of nuts for the stud construction or where screws are installed. This adds extra cost and complexity to the eyelet and installation process. Wire orientation is important for engine compartment use to prevent vehicle vibration from rotating the wire and loosening the nut, and to prevent wire pinching. One such example of a conventional orientation configuration is U.S. Pat. No. 5,292,264 entitled "Earthing Stud" which issued to Blank on Mar. 8, 1994, which discloses a threaded weld stud, interlocking plastic orientation part, and a cable terminal or eyelet; this patent is incorporated by reference herein. Another traditional construction is disclosed in EP 0 487 365 B1 to Rapid S.A.

SUMMARY OF THE INVENTION

In accordance with the present invention, a preferred embodiment of an electrical connection employs a stud having a patterned segment, a shoulder and a flange. In another aspect of the present invention, the shoulder has seven or more predominantly flat faces. In a further aspect of the present invention, the shoulder has an octagonal cross sectional shape. Still another aspect of the present invention provides a nut which is threadably engaged with the patterned segment of the stud and an eyelet secured between the nut and the flange of the stud. Yet another aspect of the present invention allows the stud to be welded onto an automotive body panel or the like for use as a grounding stud.

The stud and electrical connection of the present invention are advantageous over traditional devices in that the present invention maximizes the electrical contact area between the stud and the eyelet while also providing a set angular orientation to the eyelet and wire once the nut has been fastened onto the stud. The present invention also improves the electrical cross sectional area through the stud while also allowing for the manufacture of the stud in conventionally sized equipment. The preferred octagonal cross sectional shape of the shoulder advantageously increases automatic alignment of the eyelet, especially when the eyelet has a matching octagonal internal aperture shape, as compared to stud shoulders having six or less flat faces. The stud of the present invention advantageously accepts both an octagonally apertured eyelet for use as a grounding stud or a circularly apertured eyelet for use in other electrical stud connections such as to a junction box, battery or the like. Additional advantages and features of the present invention will become apparent from the following description and appended claims, taken in conjunction with the accompanying drawings.

DETAILED DESCRIPTION OF THE PREFERRED EMBODIMENT

Figure 1:
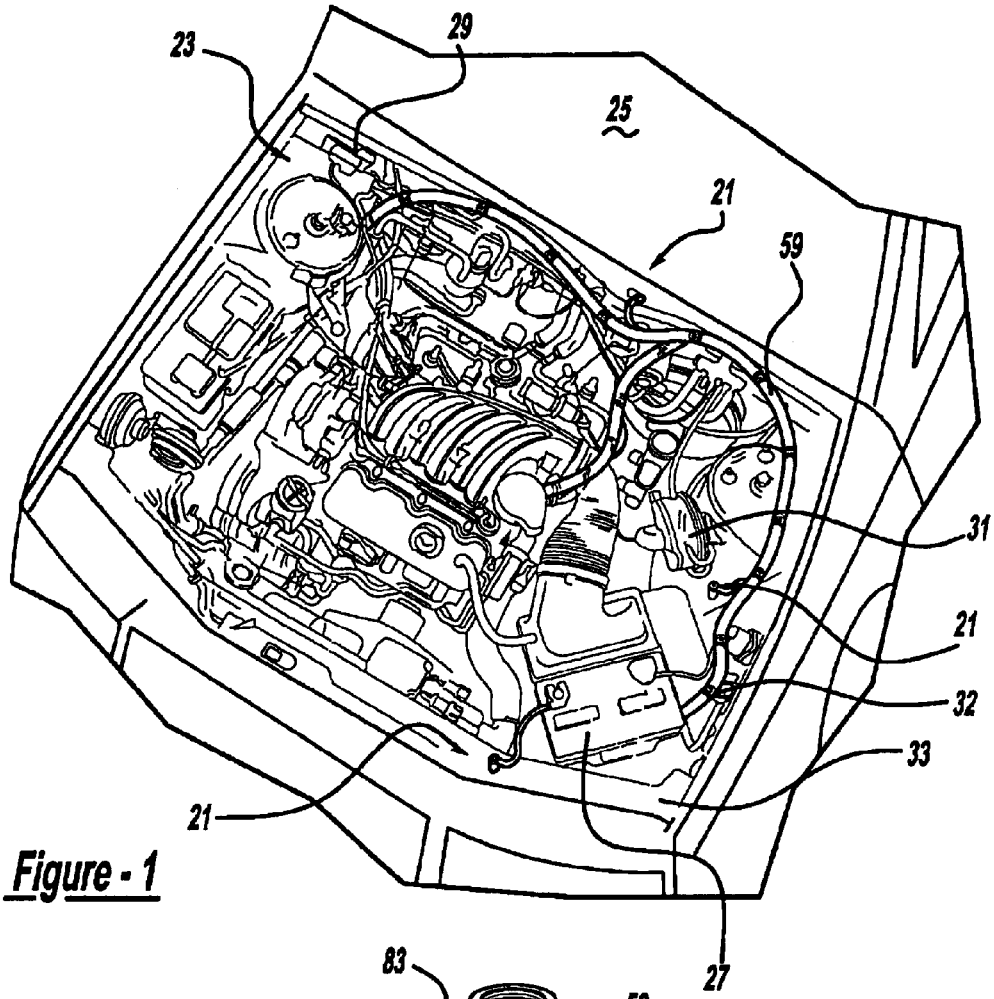
FIG. 1 is a perspective view showing an engine compartment of an automotive vehicle employing the preferred embodiment of a stud and electrical connection of the present invention.
Figure 2:
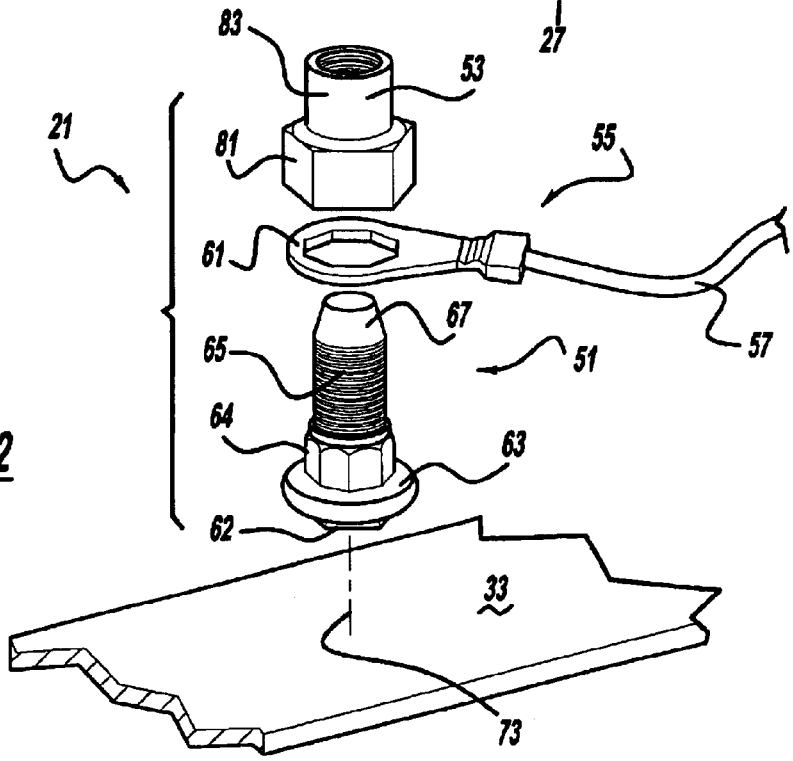
FIG. 2 is an exploded view showing the preferred embodiment stud and electrical connection.
Figure 3:
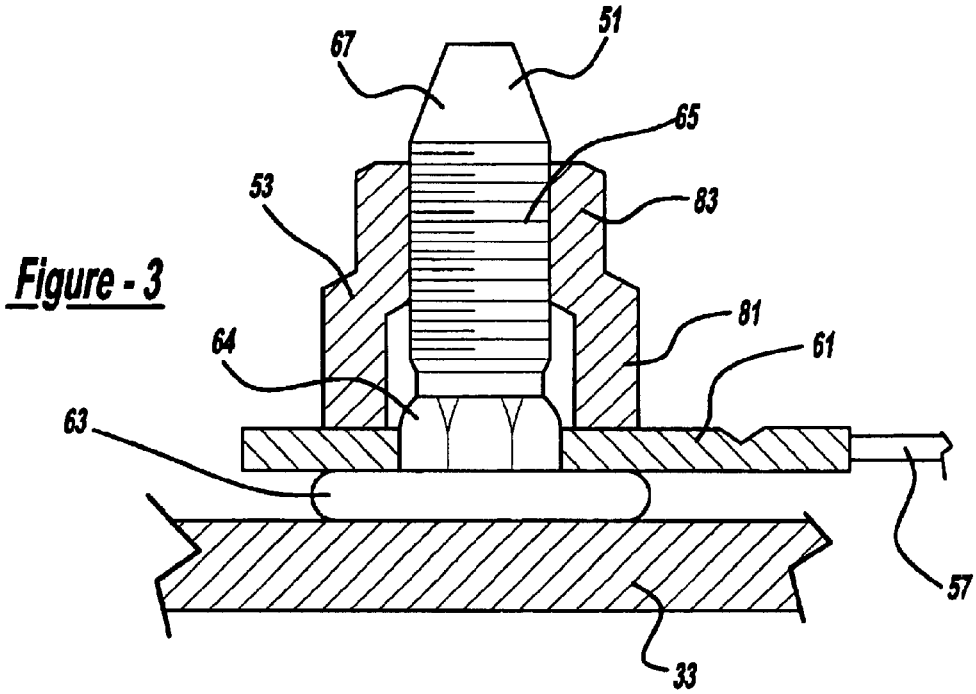
FIG. 3 is a side elevational view, taken partially in cross section, showing the preferred embodiment stud and electrical connection mounted to a vehicle body panel.
Figure 4:
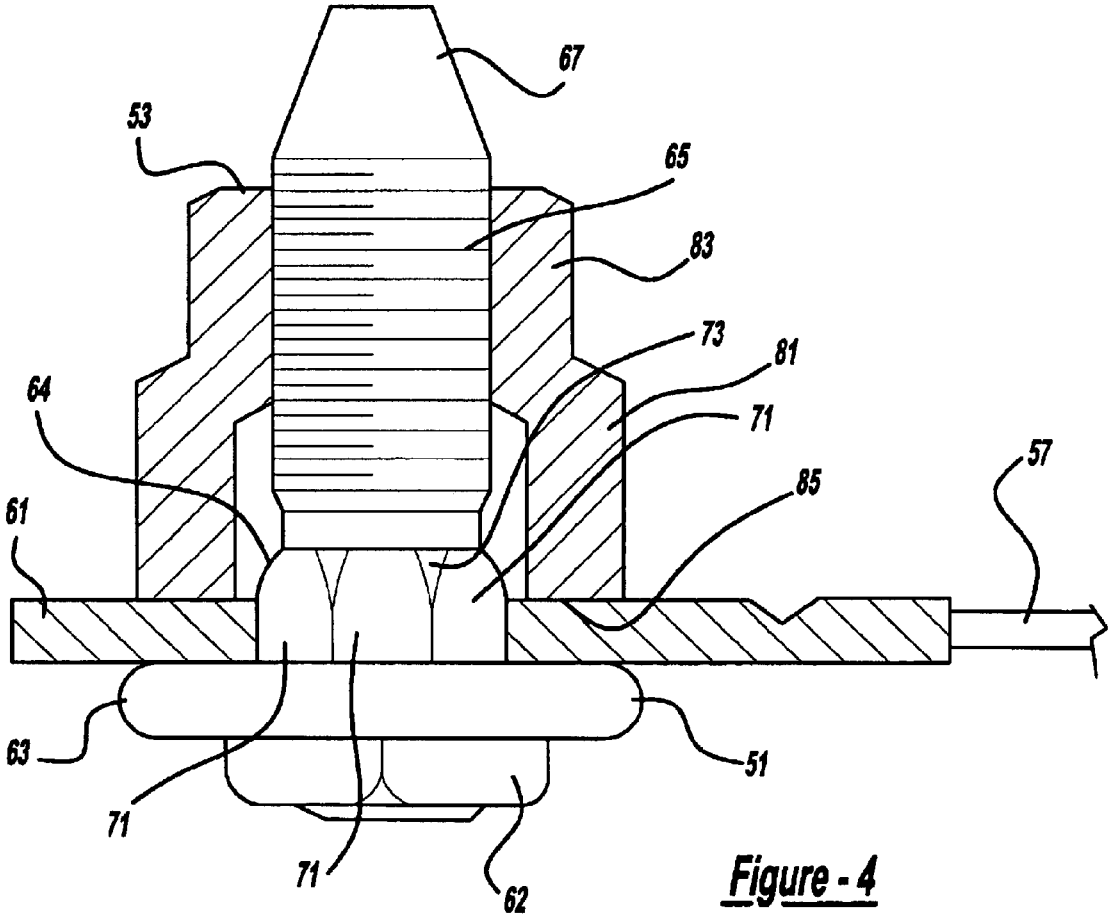
FIG. 4 is a side elevational view, taken partially in cross section, showing the preferred embodiment stud and electrical connection.
Figure 5:
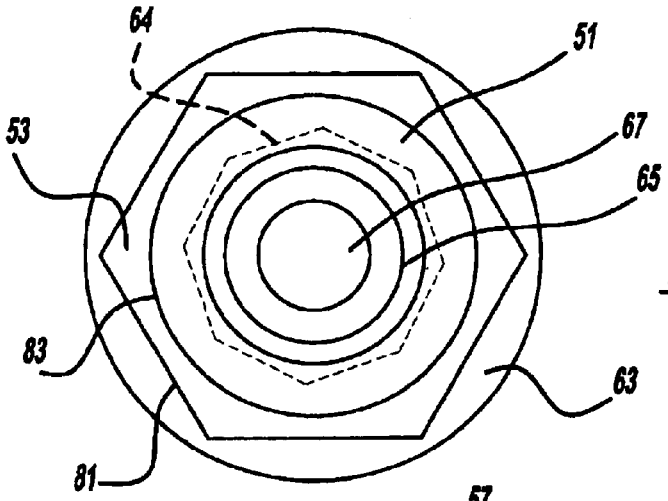
FIG. 5 is an end elevational view showing the preferred embodiment stud and nut.
Figure 6:
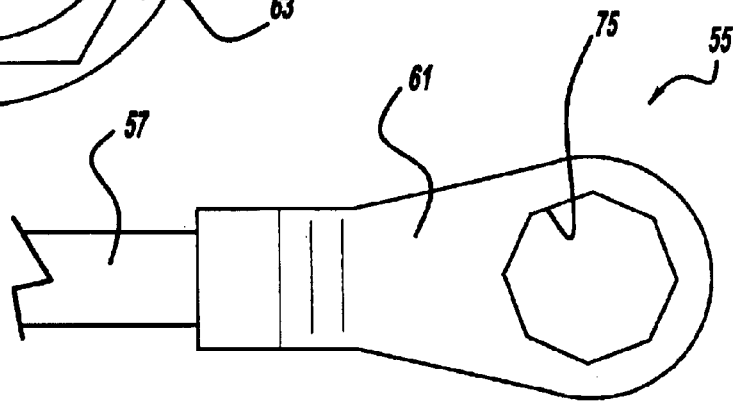
FIG. 6 is a true elevational view showing the preferred embodiment of an eyelet employed with the stud and electrical connection of the present invention.
Figure 7:
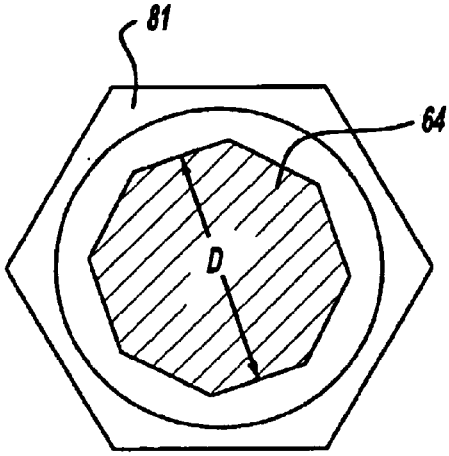
FIG. 7 is a cross sectional view showing the preferred embodiment stud and electrical connection.

FIG. 1 shows a stud electrical connection 21 of the present invention employed in an engine compartment 23 of an automotive vehicle 25. Stud electrical connection 21 is operable to conduct electricity from an electrical component, such as a battery 27, direct current window wiper motor 29, horn 31, power distribution box 32 or the like, to a conductive metal panel or frame 33 of the vehicle.

Referring to FIGS. 2–7, the preferred embodiment of stud electrical connection 21 includes a grounding weld stud 51, a nut 53, and a female electrical connector 55. Electrical connector 55 includes a wire 57, branching from a wire harness 59 (see FIG. 1), with a stamped metal eyelet 61 crimped onto an end thereof. Wire 57 is made of a flexible copper inner wire surrounded by an insulative casing.

Stud 51 includes a securing segment 62, a flange 63, a shoulder 64, a patterned segment 65 and an inwardly tapered frusto-conical end segment 67. Securing segment 62 has a hexagonal cross sectional shape with a centrally raised button. This portion forms the weld pool of material when stud 51 is drawn arc welded to panel 33. Flange 63 has a circular peripheral shape and transversely extends beyond the rest of stud 51.

Shoulder 64 is defined by a set of generally flat faces 71 that are connected together and surround a longitudinal centerline 73 of stud 51. It is important that shoulder 64 has more than six distinctly separate and angularly offset faces that are connected together in a polygonal manner when viewed in cross section. It is preferred that faces 71 of shoulder 64 define an octagonal shape in cross section. Rounded upper corners 73 are located between portions of each adjacent pair of faces 71. The distance D between opposed faces 71 is preferably between 6.13 and 6.0 millimeters. Patterned segment 65 has a M 6.0×1.0 millimeter spiraling thread. The thread defines an external engagement pattern on the stud. Stud 51 is made as an integral single piece from 10B21, heat treated class 8.8 steel.

The preferred embodiment eyelet 61 has an internal aperture 75 defined by an octagonally shaped edge. Aperture 75 of eyelet 61 closely matches the size of shoulder 64; close dimensional tolerances of aperture 75 and shoulder 64 are important.

Nut 53 has an enlarged section 81 and a coaxial, circular-cylindrical, reduced section 83. A hexagonal cross sectional shape is externally provided on enlarged section 81 while a spiral thread is disposed within reduced section 83 for engaging the threads of stud 51. Enlarged section 81 has an end 85 which abuts against and compresses eyelet 61 against flange 63 of stud 51, when nut 53 is rotatably tightened by a torque wrench or the like upon stud 51. In the fully fastened position, enlarged section 81 of nut 53 externally surrounds and covers at least part of shoulder 64. Nut 53 is preferably of a progressive torque, crown lock variety.

In the electrical grounding stud application, stud 51 is first welded to panel 33. Next, eyelet 61 is manually placed around threaded segment 65 of stud 51. Nut 53 is thereafter rotatably driven onto stud. The rotation of nut 53 will cause the octagonal aperture 75 of eyelet 61 to become automatically aligned with the matching faces of the octagonal shoulder 64, thereby allowing a fixed orientation of eyelet 61 and wire 57 relative to stud 51. Nut 53 is then fully torqued onto stud. It is believed that the octagonal shape maximizes the face-to-face dimension D and also the corner-to-corner dimension of shoulder 64; this significantly increases the electricity flow path and conductivity of the portion of stud 51 which is electrically connected to the current carrying eyelet 61. Notwithstanding, the cross sectional dimensions of shoulder 64 still allow for manufacturing of stud 51 in conventionally sized processing equipment. Additionally, the octagonal cross sectional shape of shoulder 64 allows for reduced circumferential rotation or angular displacement of the corresponding eyelet before alignment is achieved, especially compared to hexagonal or square cross sectional shapes.

Figure 8:
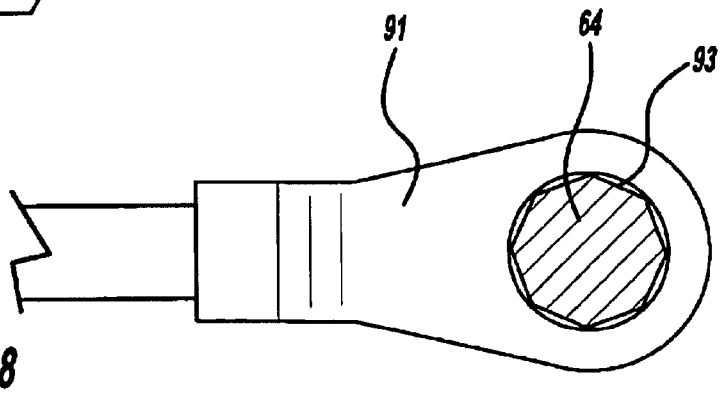
FIG. 8 is a true elevational view showing an alternate embodiment eyelet employed with the stud and electrical connection of the present invention.

An alternate embodiment eyelet 91 is shown in FIG. 8. This eyelet 91 has a circular internal aperture 93 which fits around octagonal shoulder 64. This eyelet configuration is more suitable for non-grounding electrical connections, such as for junction boxes or batteries, where locked in wire orientation is not as important.

While the preferred embodiment grounding stud and electrical connection have been disclosed, it should be appreciated that other aspects can be employed within the scope of the present invention. For example, the securing segment of the stud can alternately have a screw thread, be suitable for spot welding or have an interference fit type push in configuration to the adjacent panel or member. Additionally, the internal nut threads can be replaced by inwardly projecting formations that are in a non-spiral configuration. Furthermore, nut 53 can be replaced by a crimped on collar. The stud electrical connection can also be used for non-automotive apparatuses such as household appliance, power tools or industrial machines. While various materials have been disclosed, other materials may be employed. It is intended by the following claims to cover these and any other departures from the disclosed embodiments which fall within the true spirit of this invention.

The invention claimed is:

1. An electrical connection comprising:

an elongated stud having an enlarged flange, a shoulder and a patterned segment, the shoulder being located between the flange and the patterned segment, the shoulder having at least seven substantially flat faces circumferentially located around a longitudinal axis of the stud; and a fastener removably secured to the stud, the fastener having an enlarged section operably enclosing at least a portion of the shoulder of the stud, the enlarged section of the fastener having at least four substantially flat faces circumferentially located around a longitudinal centerline of the fastener, and the fastener also having another section, of a different shape than the enlarged section, coaxially aligned with the enlarged section.

2. The electrical connection of claim 1 wherein the patterned segment of the stud includes at least one spiral thread.

3. The electrical connection of claim 2 wherein the fastener is a rotatable nut having an internal thread operably engaging the thread of the stud.

4. The electrical connection of claim 3 wherein the another enlarged section of the fastener is substantially cylindrical.

5. The electrical connection of claim 1 wherein the flange of the stud has a circular periphery coaxially aligned with the longitudinal centerline.

6. The electrical connection of claim 1 wherein the stud further includes a weldable segment located on an opposite side of the flange from the shoulder.

7. The electrical connection of claim 1 wherein the shoulder includes curved portions between sections of adjacent pairs of the faces, and the faces define a polygonal cross sectional shape.

8. The electrical connection of claim 1 further comprising an automotive vehicle body panel, wherein the stud is a grounding stud welded to the panel.

9. The electrical connection of claim 1 wherein the shoulder has eight faces arranged in an octagonal cross sectional configuration.

10. An electrical assembly comprising:

a threaded segment spiraling around a longitudinal centerline;

a shoulder located adjacent the threaded segment and having at least eight substantially flat faces surrounding the longitudinal centerline and defining a polygonal cross sectional shape;

an enlarged flange located adjacent the shoulder opposite the threaded segment, the flange being transversely larger than the shoulder and the threaded segment;

a securing segment located on an opposite side of the flange from the shoulder;

wherein the threaded segment, shoulder, flange and securing segment are parts of a single metallic member operable to conduct electricity; and a fastener removably secured to the threaded segment, the fastener having an enlarged section operably enclosing at least a portion of the shoulder of the stud, the enlarged section of the fastener having at least four substantially flat faces circumferentially located around a longitudinal centerline of the fastener, and the fastener also having another section, of a different shape than the enlarged section, coaxially aligned with the enlarged section.

11. The electrical assembly of claim 10 wherein the shoulder has eight faces which define an octagonal cross sectional shape.

12. The electrical assembly of claim 10 wherein the flange has a circular peripheral shape and a substantially flat face adjacent the shoulder.

13. The electrical assembly of claim 10 wherein the securing segment has a polygonal cross sectional shape and is adapted to be welded onto an adjacent panel.

14. An automotive electrical connection system comprising:

(a) a metallic vehicle panel;

(b) a grounding stud including:

a threaded segment spiraling around a longitudinal centerline;

a shoulder located adjacent the threaded segment and having at least eight angularly offset faces defining a polygonal cross sectional shape;

an enlarged flange located adjacent the shoulder opposite the threaded segment, the flange being transversely larger than the shoulder and the threaded segment; and a securing segment located on an opposite side of the flange from the shoulder, the securing segment being attached to the vehicle panel; and (c) a nut having an enlarged segment and a reduced segment, the enlarged segment having a polygonal peripheral shape and the reduced segment having a substantially circular peripheral shape, the reduced section having at least one internal formation operably engaging the threaded segment of the stud, the nut being rotatably securable to the stud, the enlarged section of the nut being operably located around an outside of at least a portion of the shoulder when the nut is fully secured to the stud.

15. The system of claim 14 wherein the shoulder of the stud has an octagonal cross sectional shape.

* * * * *

UNITED STATES PATENT AND TRADEMARK OFFICE

CERTIFICATE OF CORRECTION

PATENT NO. : 6,746,285 B2
APPLICATION NO. : 10/075090
DATED : June 8, 2004
INVENTOR(S) : Delcourt et al.

It is certified that error appears in the above-identified patent and that said Letters Patent is hereby corrected as shown below:

On the Title page,

[*] Notice: Subject to any disclaimer, the term of this patent is extended or adjusted under 35 USC 154(b) by 94 days Delete the phrase "by 94 days" and insert -- by 143 days--

Signed and Sealed this

Thirteenth Day of November, 2007

JON W. DUDAS
*Director of the United States Patent and Trademark Office*